United States Patent [19]

Grant

[11] Patent Number: 4,690,291

[45] Date of Patent: Sep. 1, 1987

[54] BARBED LID CLOSURE

[76] Inventor: Alan H. Grant, 3208 Woodhollow Dr., Chevy Chase, Md. 20015

[21] Appl. No.: 846,802

[22] Filed: Apr. 1, 1986

[51] Int. Cl.[4] ..... B65D 41/16

[52] U.S. Cl. ..... 215/32

[58] Field of Search ..... 215/32, 253, 252

[56] References Cited

U.S. PATENT DOCUMENTS

| | | | |
|---|---|---|---|
| Re. 31,101 | 12/1982 | Berghahn et al. | 206/1.5 |
| 3,025,989 | 3/1962 | Williams . | |
| 3,438,536 | 4/1969 | Tarchalski . | |
| 3,458,079 | 7/1969 | Gasbarra . | |
| 3,654,675 | 4/1972 | Peterson | 27/1 |
| 4,001,928 | 1/1977 | Schweiso | 29/447 |
| 4,024,976 | 5/1977 | Acton | 215/32 |
| 4,147,268 | 4/1979 | Patel et al. | 215/252 |
| 4,210,258 | 7/1980 | von Holdt | 220/306 |
| 4,251,002 | 2/1981 | Middleton et al. | 215/253 |
| 4,326,014 | 4/1982 | Dey | 429/48 |
| 4,511,053 | 4/1985 | Brandes et al. | 215/252 |

*Primary Examiner*—Donald F. Norton

*Attorney, Agent, or Firm*—Berman, Aisenberg & Platt

[57] ABSTRACT

A container includes a closure having a neck with a break-away ring. A cap which covers the neck has a depending edge with a barb-like tip which is received in the space between the break-away ring and the neck of the container. During an initial opening operation, sloped surfaces on the cap and break-away ring engage to force the break-away ring outwardly to remove it from the neck. This provides both tamper and child-proof features. After the initial opening operation, the cap may be secured to the neck by a separate connection.

11 Claims, 4 Drawing Figures

BARBED LID CLOSURE

FIELD

This invention relates to the art of containers and closures therefor.

BACKGROUND ART

Various types of containers having closures are known in the art. The traditional threaded neck and threaded cap is still in wide use, but a wide variety of connections other than the simple threaded connection has been proposed. For example, U.S. Pat. Nos. 3,458,079 (Gasbarra); 4,210,258 (vonHoldt); Re: 31,101 (Berghahn et al.); 4,001,928 (Schweiso); 3,438,536 (Tarchalski); 3,654,675 (Peterson); and 4,426,014 (Coltman, Jr.) show closures for containers wherein the connection between the neck of the container and a lid involves a connection between two parts other than the typical threaded connection. None of these patents is directed to a tamper-proof container and would thus, be vulnerable to tampering.

U.S. Pat. Nos. 3,025,989 (Williams); 4,251,002 (Middleton et al.); and 4,147,268 (Patel et al.) are directed to tamper-proof closures. The Williams patent employs a breakable strip which is severed by saw teeth on a movable cap to open the container.

SUMMARY OF THE INVENTION

In accordance with the invention, a unique closure for a container is provided wherein the neck of the container has a break-away ring attached to its outer surface, and a cap covering the neck has a depending edge which mates with the ring to close the container. The depending edge preferably includes a sloped surface and a ledge to form a barb which mates with a similarly-shaped pair of surfaces on the break-away ring. The mating ledges prevent the cap from being removed, while the mating sloped surfaces cause the break-away ring to be forced outwardly when the cap is pushed downwardly. If the cap is pushed far enough, the connection between the break-away ring and the neck breaks, thus allowing the cap to be removed. The presence of the break-away ring in a severed condition immediately alerts the user that the container has been opened. This is useful to a blind person as well because he can easily feel that the break-away ring is detached from its sealed position.

The interior of the cap preferably includes means for securing the cap to the neck during ordinary usage after the break-away ring has been severed from the neck in the initial opening operation.

This structure provides an easily-opened container because it is only necessary to push the cap downwardly to force the break-away ring outwardly to sever it from the neck of the container. This operation is quite easy for an adult, but can be made difficult for a child to make the container child-proof.

The container is tamper proof because the cap can not be removed without severing the break-away ring in one embodiment, or the upper edge of the cap extends beyond the upper edge of the break-away ring to forestall any attempt to pull the break-away ring outwardly without clearly damaging the material in another embodiment. In the first embodiment, the mating ledges are of sufficient depth that, when assembled, the break-away ring cannot be urged outwardly far enough to release the barbed edge of the cap without fracturing the connection between the break-away ring and the neck.

It is an object of this invention to provide a unique container, wherein a neck includes a break-away ring which mates with a lip of a cap.

Another object of this invention is to provide a closure for a container wherein a cap has a barbed depending edge which mates with a break-away ring.

DETAILED DESCRIPTION

Figure 1:
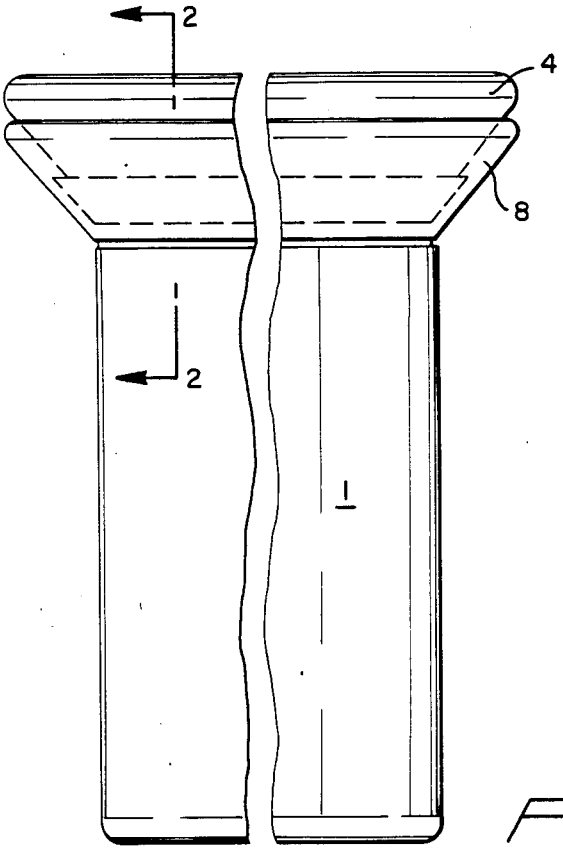
FIG. 1 is a side view of a container in accordance with the invention.

FIG. 1 shows a container 1 having a cap 4 thereon. Cap 4 is held to the container by retaining means 8.

Figure 2:
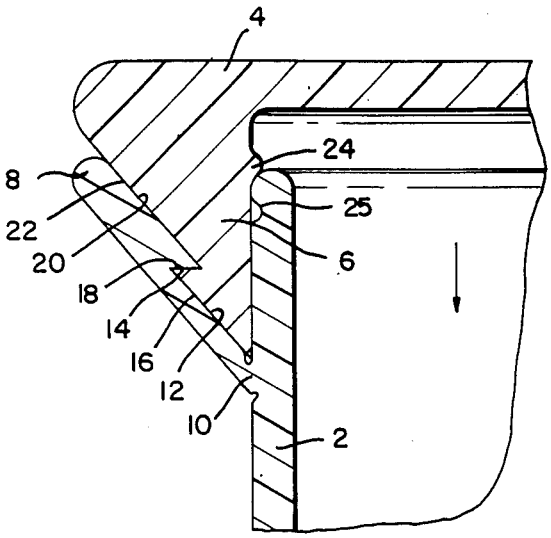
FIG. 2 is a partial longitudinal cross-section taken along line 2—2 of FIG. 1.

FIG. 2 is a longitudinal cross-section of neck 2 of container 1 having cap 4 thereon in the sealed position. The cap 4 includes a depending edge 6 which mates with a removable retaining means 8 in the form of a break-away ring. Retaining means 8 is secured to neck 2 at a frangible connection 10.

Connection 10 is made frangible preferably by narrowing the thickness of the material at that point. Alternatively, the connection is perforated to weaken it.

Depending edge 6 of cap 4 includes a first sloped surface 12 and a ledge 14, these two surfaces producing a kind of barbed tip on the depending edge 6. Retaining means 8 includes a sloped surface 16 generally parallel to first sloped surface 12, and a ledge 18 generally parallel to ledge 14. It will be appreciated that sloped surface 16 and ledge 18 form a recess for receiving the barbed tip of the depending edge 6 formed by surface 12 and ledge 14.

The above-described structure may be assembled by molding neck 2 and retaining means 8 around depending edge 6, or retaining means 8 may be flexed outwardly to allow insertion of depending edge 6 at a point in the manufacturing process during which frangible connection 10 is made flexible. After completion of the manufacturing process, frangible connection 10 will break if retaining means 8 is flexed outwardly enough such that ledge 18 does not engage ledge 14 which would allow cap 4 to be removed. Since retaining means 8 necessarily fractures at frangible connection 10, it is not possible to remove lid 4 without severing means 8 from neck 2.

It is also preferred for cap 4 to have a second sloped surface 20 located above and generally parallel to first sloped surface 12. Retaining means 8 includes a sloped surface 22 which is generally parallel to sloped surface 20.

In the initial opening operation, cap 4 is forced downwardly in the direction shown by the arrow in FIG. 2. This causes first sloped surface 12 to engage sloped surface 16 and second sloped surface 20 to engage sloped surface 22. As cap 4 is forced further downwardly, the engagement of these sloped surfaces causes retaining means 8 to be forced outwardly and to pivot about frangible connection 10. This causes the frangible connection to break whereupon cap 4 may be removed from neck 2. Also, edge 6 can include a pointed tip which assists in breaking connection 10 in a shearing action.

When it is desired to re-close the container, cap 4 is again placed on neck 2 and means are provided for securing the cap to the neck. In an exemplary embodiment, cap 4 includes a nub 24 which mates with a groove 25 during re-closing of the container.

In the preferred embodiment, neck 2 and cap 4 are circular resulting in the sloped surfaces 12, 16, 20, and 22 being conical and ledges 14 and 18 being annular. It will be appreciated, however, that neck 2 and cap 4 could be rectangular such that the sloped surfaces and the ledges would be planar.

It will be appreciated that retaining means 8 will normally not become separated from cap 4 during opening. Ledges 14 and 18 should be of depths sufficient to prevent release of retaining means 8 from cap 4 after connection 10 has been broken to provide tamper proofing. Retaining means 8 simply stays with cap 4 in this embodiment, and tampering is evident by the presence of the broken connection 10.

Figure 3:
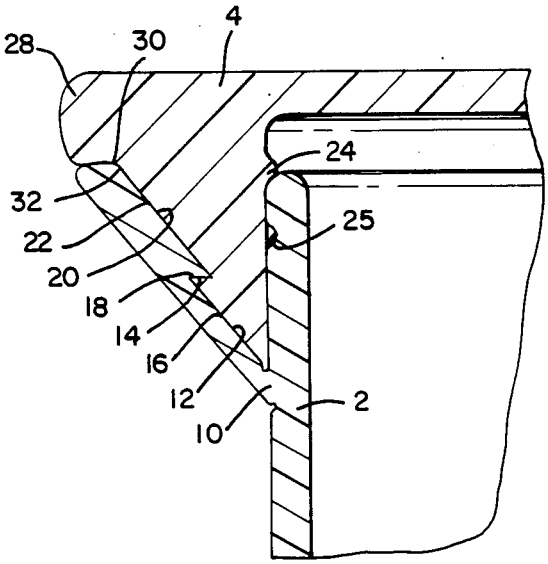
FIG. 3 is a cross-section of a second embodiment of a closure in accordance with the invention.
Figure 4:
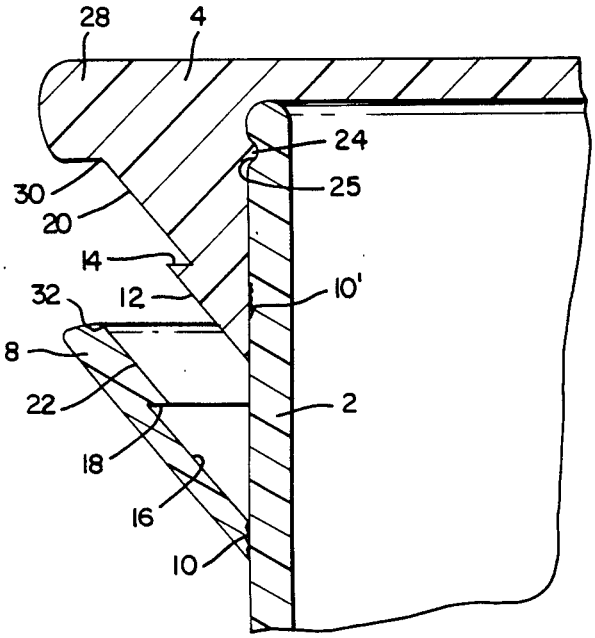
FIG. 4 is a longitudinal cross-section of the second embodiment of the closure in accordance with the invention.

In a second embodiment shown in FIGS. 3 and 4, cap 4 includes a protruding portion 28 which covers the upper end of retaining means 8 and is in engagement with it. In this embodiment, cam surface 30 is provided to cooperate with an upper surface 32 of retaining means 8 to force the retaining means to slide easily outwardly around protruding portion 28 as cap 4 is pushed downwardly in the initial opening operation. In the second embodiment, it is extremely difficult to pry the retaining means 8 away from cap 4 without damaging the material to an obvious extent because of their close connection, and this provides insurance against tampering. In this second embodiment, ledges 14 and 18 may be of such depths that connection 10 breaks only after the ledges have become detached. Then, break away ring 8 breaks away and slides down the neck as shown in FIG. 4 where 10' represents the location at which the ring 8 was initially connected. Visual evidence of the container's being opened is thus greater.

If additional tamper proofing is desired, a heat shrinkable band can be secured around the intersection of the cap and retaining means.

It will be appreciated that a unique closure for a container having both tamper and child-proof features has been described. Variations of the preferred embodiment within the scope of the appended claims will be apparent to those of skill in the art.

I claim:

1. A closure for a container comprising neck means for allowing passage of material therethrough, removable cap means for sealing said neck means, and removable retaining means for holding said cap means to said neck means, said cap means comprising an annulus having a first surface and a second surface contiguous and transverse to said first surface to form a ledge, said removable retaining means comprising a third surface extending generally parallel to said first surface and a fourth surface extending generally parallel to said second surface, said removable retaining means being connected to said neck means by frangible means, wherein said second and fourth surfaces engage to hold said cap means to said neck means and said first and third surfaces engage when said cap means is moved with respect to said neck means in a first direction transverse to said first and third surfaces to break said frangible means.

2. A closure according to claim 1 further comprising means for holding said cap means on said neck means when said frangible means is broken.

3. A closure according to claim 2 wherein said means for holding comprises a nub which fits in a groove to hold said cap means to said neck means.

4. A closure according to claim 1 wherein said cap means comprises a fifth surface generally parallel to said first surface and said retaining means comprises a sixth surface generally parallel to said fifth surface, said fifth and sixth surfaces engaging when said cap means is moved in said first direction to force said retaining means away from said neck means.

5. A closure according to claim 1 wherein said first and third surfaces are conical and said second and fourth surfaces are annular.

6. A closure according to claim 5 wherein said neck means is tubular and said retaining means is attached to the exterior of said neck means.

7. A closure according to claim 1 wherein an upper part of said cap means extends outwardly beyond the uppermost part of said retaining means and includes a cam surface to engage and urge said uppermost part outwardly when said cap means is moved in said first direction.

8. A closure according to claim 7 wherein said upper part of said cap means is contiguous to said uppermost part of said retaining means.

9. A closure according to claim 8 wherein said second and fourth surfaces are of a depth such that said second and fourth surfaces become disengaged before said frangible means breaks.

10. A closure according to claim 1 wherein said retaining means is on the exterior of said neck means.

11. A closure according to claim 1 wherein said cap means includes means for engaging and partially shearing said frangible means.

* * * * *